United States Patent [19]

Brock

[11] 4,266,621

[45] May 12, 1981

[54] WELL CASING WINDOW MILL

[75] Inventor: Kenneth A. Brock, Lafayette, La.

[73] Assignee: Christensen, Inc., Salt Lake City, Utah

[21] Appl. No.: 933,469

[22] Filed: Aug. 14, 1978

Related U.S. Application Data

[63] Continuation of Ser. No. 808,806, Jun. 22, 1977, abandoned.

[51] Int. Cl.[3] ..... E21B 10/46

[52] U.S. Cl. ..... 175/329; 175/399; 175/402; 175/385; 175/410; 166/55.3

[58] Field of Search ..... 175/329, 399, 402, 410, 175/398, 385, 411; 166/55.3

[56] References Cited

U.S. PATENT DOCUMENTS

| | | | |
|---|---|---|---|
| 2,217,889 | 10/1940 | Carpenter et al. | 175/329 |
| 2,360,425 | 10/1944 | Kinzbach | 175/399 |
| 3,367,430 | 2/1968 | Rowley | 175/329 |
| 3,583,504 | 6/1971 | Aalund | 175/398 |
| 3,861,477 | 1/1975 | Lazayres | 175/329 |

*Primary Examiner*—William F. Pate, III

*Attorney, Agent, or Firm*—Subkow and Kriegel

[57] ABSTRACT

A diamond milling cutter for elongating a laterally opening window in a well casing set in a well bore extending into the earth. The mill has a revolving surface which engages a sidetracking whipstock or the edge of the casing being milled to urge the mill off dead center on the casing edge and enhance the cutting action. One or more eccentric lobes engage the whipstock and cause the mill to revolve on a gyrating or non-fixed axis and effect oscillation of the cutter center laterally of the edge, or a broadly conical nose on the cutting face of the mill provides a wedge action against the casing to laterally move the mill off center and enhance the cutting action.

40 Claims, 13 Drawing Figures

WELL CASING WINDOW MILL

This application is a continuation of pending application Ser. No. 808,806, filed June 22, 1977, now abandoned.

In the drilling or completion of wells, such as oil and gas wells, wherein casing is set in the well bore, it is sometimes necessary or desireable to provide one or more laterally extended bore holes by a procedure known as "sidetracking". Sidetracking has been accomplished in a number of manners. A casing mill may be employed having laterally projecting cutters which can cut out an elongated section of the well casing. Thereafter the well is sidetracked by locating and orienting a whipstock in the well bore in the region of the milled section, and drilling off the whipstock at a selected angle and direction, through the axial gap in the casing provided by milling out the casing section.

In another case, the whipstock may be set in the casing, and a starting mill employed to initiate the cutting of a lateral window in the casing opening in a direction determined by the whipstock. Thereafter, a window mill is employed to extend the window longitudinally of the casing, and then the sidetracked hole can be drilled through the window.

All of these operations are performed by running the various cutting devices on a drill pipe string, and each change of drill or mill requires round-tripping the drill pipe, at great expense. The second procedure described above, the cutting of a window in the casing off a casing whipstock, has been found less costly. However, the use of the typical window mill results in the mill reaching a point in the cutting or milling operation at which the mill is revolving on a dead center position and not effectively milling the casing. In the case of a mill having a conical, axial cavity in its end face the mill may form on the casing a point projecting into the center of the mill and interferring with the progression of the milling operation.

To avoid such problems, a window mill has been developed which has a flat milling end face, with no central cavity, but having diamond cutters at the center of the mill. In use, however, even such flat-faced diamond mills have been found to arrive at a dead center position on the edge of the casing being milled, at which time the drilling progression is retarded. When this occurs, the drill string may be prematurely round tripped to change mills, but practice has indicated that increased weight can be temporarily applied to the mill to cause it to move off center, because of longitudinal flexure of the lower drill collar in the drill string. Such technique, however, requires particular attention, and unnecessary round tripping is a costly error.

The present invention provides a flat faced milling cutter for forming casing windows in sidetracking operations in the drilling or completion of wells in the earth formation, wherein the milling cutter cannot remain in a dead center cutting position, cutting is enhanced, and it is therefore not necessary to apply extra weight to move the milling cutter off dead center. The milling cutter is so constructed that the drilling rate will not be reduced because of the mill turning on center on the edge of the casing. As a consequence, the window milling operation is reliably less expensive, because the milling operation is more effective, requires less time, and unnecessary round tripping of the drill string is avoided.

More particularly the invention provides a diamond milling cutter formed with essentially a flat milling face, combined with a formation which prevents the mill from rotating on center on the edge of the casing, at the bottom of the window.

To accomplish this, the mill has, according to certain forms, one or more eccentric offsets in the side wall or gauge surrounding the cutting face, whereby the periphery of the mill, which engages the whipstock, causes the mill to gyrate or oscillate, so that the center of the cutting face cannot rotate on a fixed axis. Thus, the milling or cutting action at the center of the tool is enhanced and it becomes unnecessary to apply extra weight on the mill and flex the drill string to kick the mill off center. In other forms, the milling face has a forwardly projecting broadly conical center, sloping from a central point towards a flat, annular cutting section between the center and the periphery of the bit, to provide a wedge angle or surface acting on the casing, rather than the whipstock, to urge the mill laterally off dead center on the edge of the casing even though the mill is revolving about a fixed, rather than a gyrating or oscillating axis.

This invention possesses many other advantages, and has other objects which may be made more clearly apparent from a consideration of several forms in which it may be embodied. Such forms are shown in the drawings accompanying and forming part of the present specification. These forms will now be described in detail for the purpose of illustrating the general principles of the invention; but it is to be understood that such detailed description is not to be taken in a limiting sense.

Referring to the drawings.

Figure 3:
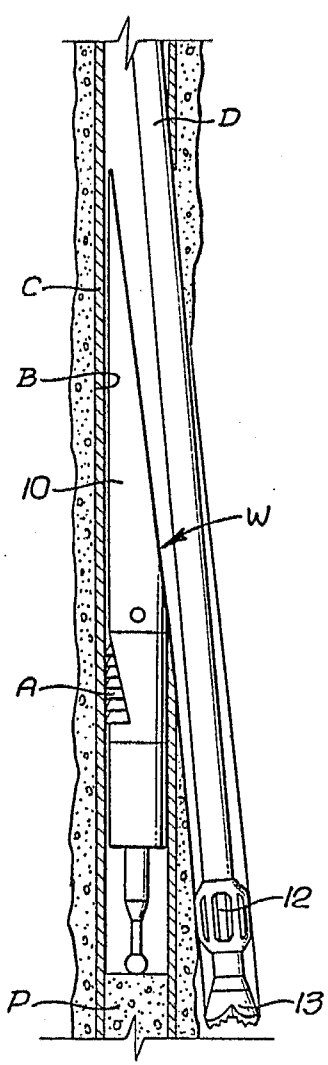
FIG. 3 is a view corresponding to FIG. 1 and FIG. 2 but showing the continued drilling of the sidetracked bore hole.
Figure 2:
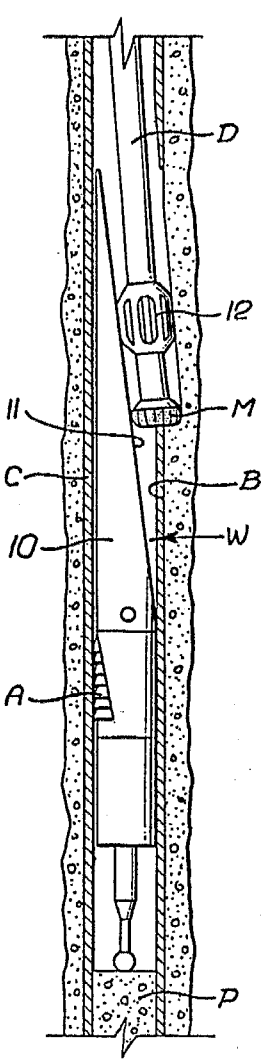
FIG. 2 is a view corresponding to FIG. 1 showing the elongation of the window by the milling cutter.
Figure 1:
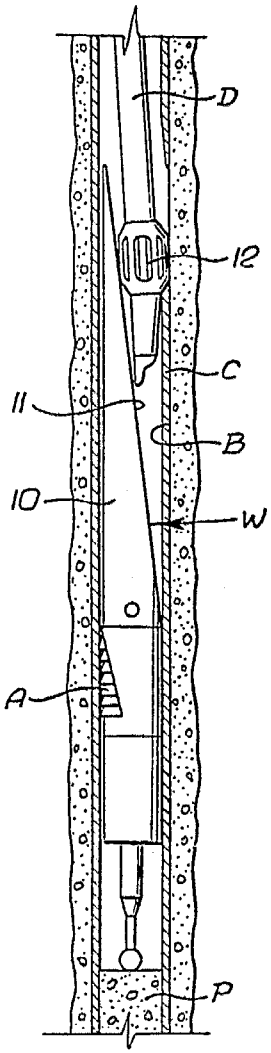
FIG. 1 is a diagrammatic view partly in vertical section and partly in elevation illustrating a first stage of forming a window in a well casing.

As seen in the drawings, referring first to FIGS. 1 through 3, a well casing C is disposed in a well bore B, and a sidetracking whipstock W has been landed on a cement plug P in the casing and anchored in a selected orientation by anchor means A. The whipstock W, as is well known, has an upwardly extended deflection shoe or member 10 having a downwardly and angularly disposed side 11 which is adapted to laterally deflect a window opening side cutter mill 12 which is rotated by a string of drill pipe D extending upwardly to a drilling rig. Thereafter, the drill string D is pulled from the well and, as seen in FIG. 2, a diamond mill M has been installed at the lower end of the drill string below the window mill 12, and as the drilling continues, the milling cutter M will mill an elongated window in the casing wall, as the mill progresses downwardly along the deflection shoe 10. As the window progresses, the window mill 12 is utilized to remove burrs from the sidewalls of the window, and after the window has been completed, the drill pipe string is again removed from the well bore, unless the earth formation to be drilled is such that the mill M can be employed to continue drilling the laterally deflected bore hole. However, if the formation to be drilled requires a bit change, the drill string is again roundtripped to substitute for the mill a typical roller or other bit 13 to enable the continued drilling of the sidetracked hole, as seen in FIG. 3.

During the course of elongating the casing window, as seen in FIG. 2, in response to rotation of the window mill M by the drill pipe D, the mill reaches a position, as illustrated, at which it would be normally rotating on the upwardly facing edge 14 of the casing on or approximately on, a dead center position, so that the cutting efficiency of the typical diamond mill is minimized. Even in the case that the mill has a substantially flat bottom face, the cutting rate markedly diminishes when the mill is rotating on center. The reduced cutting rate would normally tend to suggest to a driller controlling the drilling operation that the cutting mill should be changed, resulting in the round-tripping of the drill pipe D to enable the substitution of mills. Such a round trip of the drill pipe is unnecessary but is nevertheless very expensive and time consuming. Alternatively, the driller may apply added weight to the milling cutter to cause the drill collar or drill string above the mill to bow slightly, thereby kicking the mill off center.

Figure 4:
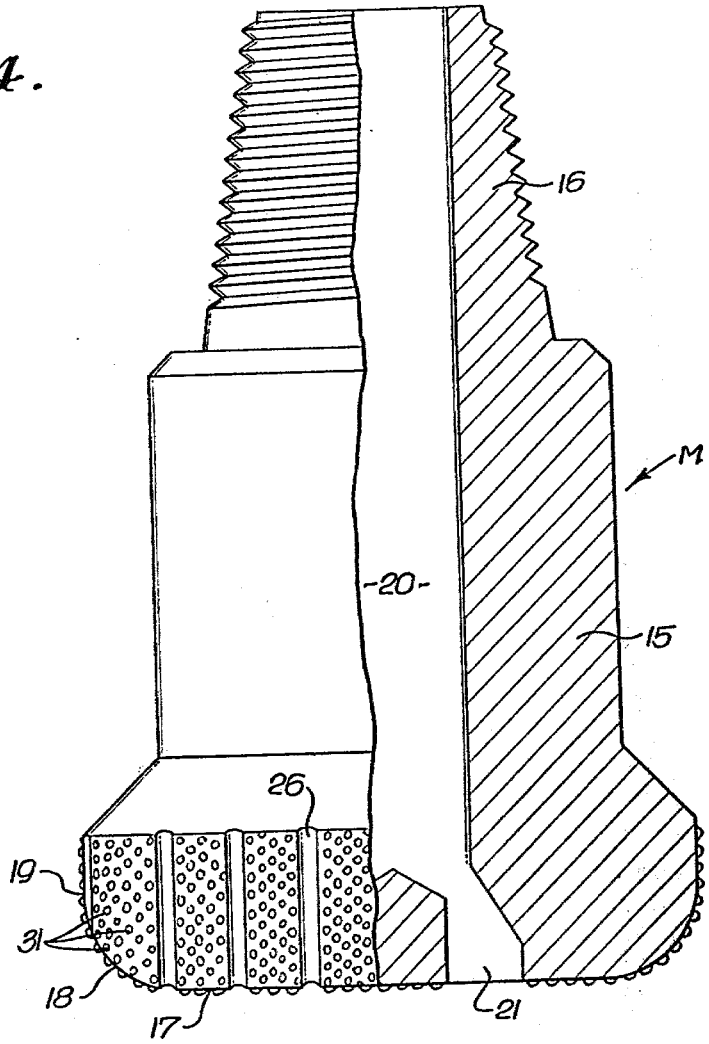
FIG. 4 is a view partly in elevation and partly in longitudinal section showing a flat faced milling cutter of the invention.
Figure 5:
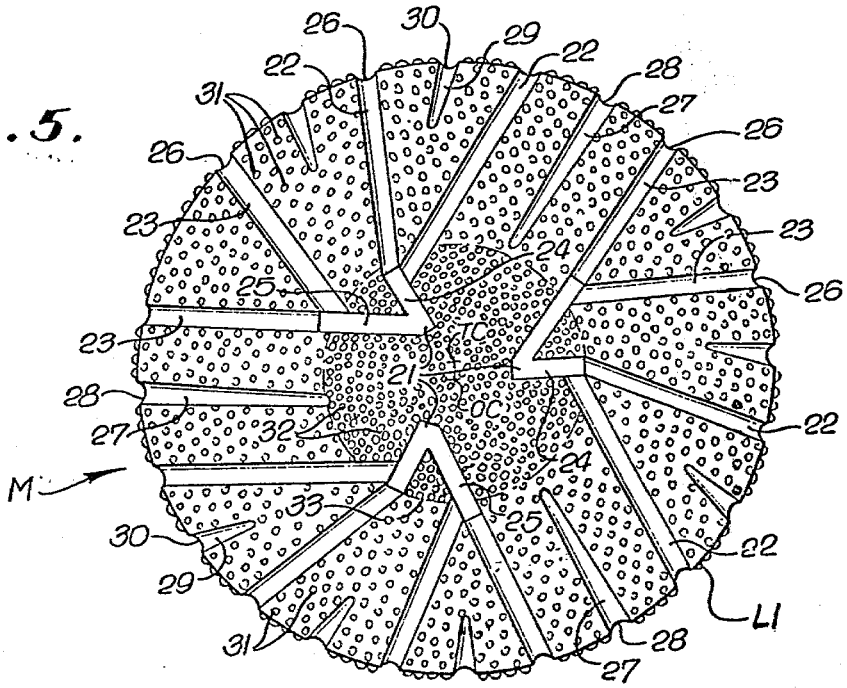
FIG. 5 is a bottom plan of the milling cutter of FIG. 4.

Referring to FIGS. 4 and 5 the mill M, according to the invention, is construced in such a manner as to avoid the problems attendant to the mill rotating on a dead center position. In this form, the mill M comprises a body 15 having at its upper end an external threaded pin or neck 16 adapted for threaded engagement in the box at the lower end of the drill collar string D. At its lower end, the mill body has a substantially flat milling face 17 extending perpendicular to the axis of the body 15 and arching upwardly and outwardly at 18 to the bit gage 19. Extending longitudinally through the mill body 15 is a drilling fluid passageway 20 opening at a plurality of locations through the bottom face 17 of the bit. The passage 20 leads to a plurality of circumferentially spaced crow-foot shaped drilling fluid discharge passages 21 which are radially spaced from the center of the cutting face 17 so that the flat face 17 extends across the center of the mill and there is no depression or fluid passage at the center of the face.

Extending outwardly from and communicating with the respective drilling fluid discharge openings 21 are waterways or drilling fluid passages 22 and 23, the waterways 22 diverging outwardly towards the outer periphery or gage of the mill from an intersection with one branch 24 of the crow-foot shaped discharge passages 21, and the waterways 23 diverging outwardly from an intersection with the other branch 25 of the crow-foot shaped discharge passages 21. Each of the waterways 22 and 23 merges with a vertically extended waterway or groove 26 in the reaming or gage portion 19 of the mill. Extending generally radially, and spaced between adjacent primary or high-pressure waterways 22 and 23 is a number of secondary or low pressure waterways 27 which merge with vertical waterways or grooves 28 in the gage of the milling cutter. Additional short, radial secondary or low pressure waterways 29 are disposed between the primary waterways 22 and 23 and merge with vertical grooves 30 in the gage 19 of the mill. These various primary and secondary waterways in the flat face 17 define therebetween lands or surfaces containing cutting elements or diamonds 31 and 32 capable of milling the well casing material, as cooling and flushing drilling fluid is circulated downwardlyy through the drill string, through the mill central passage 20, exiting through the crow-foot shaped openings 21, then flowing through the primary waterways 22 and 23 and across the lands between the cutting elements to flush the cuttings therefrom and cool the bit as the milling progresses.

As illustrated, the cutting elements are diamonds or similar cutting elements secured in the cutting face 17 of the bit within a matrix (not shown separately), of a suitable type forming a portion of the bit body 15. It will be understood that the cutting elements may be other than the diamond cutting elements illustrated, as is well known in the art. As shown, the cutting elements 31 extend from the top of the gage portion 19 of the bit across the substantially flat underface 17 to a circle that extends about and approximately embraces the crow-foot passages 21. Within the circle 33 the cutting elements or diamonds are more densely arranged across the center of the bit between the region of the crow foot openings 21.

Characteristically, the cutting effectiveness of a cutting bit or mill as thus far described is very poor at the center of the bit, because the mill can rotate on dead center, and heretofore the cutting efficiency has been enhanced by causing the bit to be kicked off of dead center during the casing milling operation, by adding additional weight to the cutting face and causing the drill collar string to bow above the mill.

Figure 6:
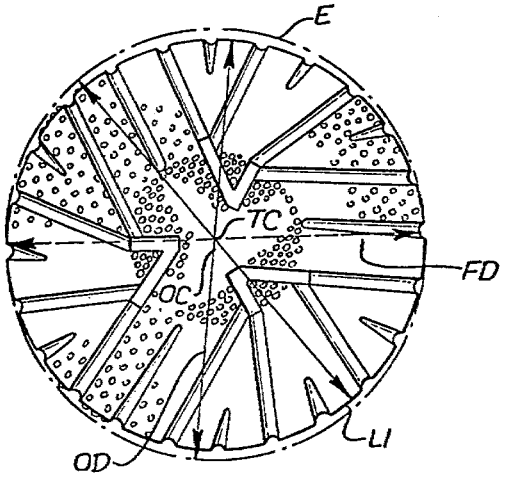
FIG. 6 is a bottom plan corresponding to FIG. 5 but illustrating the different mill diameters to produce a single lobed mill.
Figure 8:
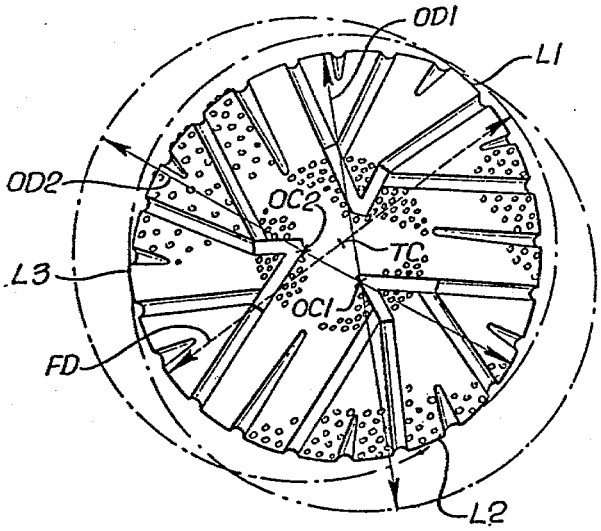
FIG. 8 is a bottom plan of another mill illustrating the different diameters for producing a three-lobed mill.
Figure 7:
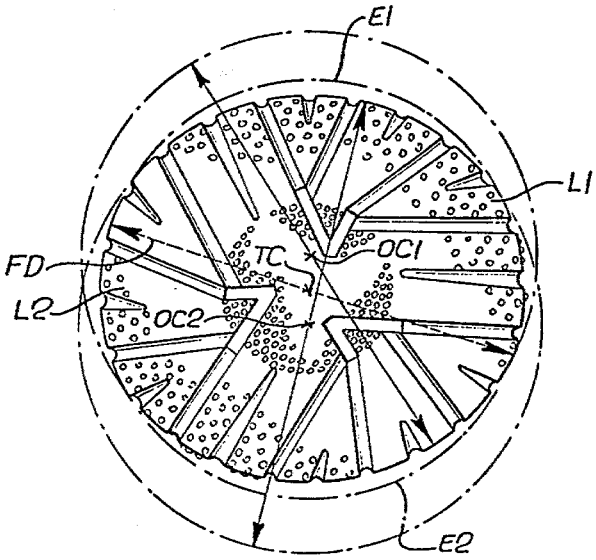
FIG. 7 is a bottom plan of another mill illustrating the different diameters for a two-lobed mill.

The milling cutter of the present invention is structured so that it cooperates with the whipstock W in such a manner that the bit cannot rotate in a dead center position and the cutting action is enhanced. Referring to FIGS. 6, 7, and 8, the milling cutter of the invention is shown with respect to diametrical lines and circles which illustrate that the gage or outer periphery of the bit has one or more eccentric peripheral portions or lobes which, upon engagement with the confronting surface of the whipstock, as will be later described, cause the center of rotation of the mill body to oscillate or gyrate, so that the central cutter elements 32 of the cutting face, in the region of the center of the bit, are caused to partake of a compound motion, enhancing the cutting action, and the mill cannot rotate about a fixed axis.

As seen in FIG. 6, the mill is formed with a single lobe or offset L1. The diametrical arrows FD show the full diameter of the usual round bit, and it will be noted that the arrows FD intersect the true center TC of the bit and that the radius of the mill is uniform over the lower 180° thereof. The solid arrow OD indicates a single offset diameter which extends through an offset center OC and the radius from the offset center over the upper 180° of the bit is uniform. Accordingly, the bit has an eccentricity as indicated by the circular broken line E, the radial extent of which is equal to the radial spacing between the true center and the offset center of the bit. The spacing of the offset of the centers and the radii can be otherwise changed to cause more or less eccentricity with resultant more or less wobble or oscillation of the center of the bit during the milling operation.

As seen in FIG. 7, the bit is formed to have two lobes or eccentric projections L1 and L2 and the bit is elliptical, to cause the bit to oscillate or gyrate during the milling operation. In this case the broken arrow FD again illustrates the full or major diameter of the bit and intersects the true center TC thereof. The double eccentricity or two lobes are provided by forming the intervening lower and upper portions of the bit which merge with the lobes L1 and L2 on diameters the centers of which are offset to locations OC1 and OC2 with the offset centers in alignment with and equally spaced from the true center. The eccentricity is shown by the broken circles E1 and E2, and can be varied by the spacing between centers.

Referring to FIG. 8, the bit will be seen to have three eccentric portions or lobes L1, L2 and L3, angularly spaced about the mill and cooperative with the whipstock to effect gyration or oscillation of the center of the bit as the drilling progresses. In this form, the original or major diameter designated by the broken arrow FD intersects the true center of the bit body and determines the radial projection of the three lobes, which are provided by forming the intervening portions of the bit on offset center C1 and offset center C2 on offset or minor diameters OD1 and OD2, whereby the body will oscillate or gyrate to enhance the cutting action at the center. In this form the offset centers OC1 and OC2 have been offset from the true center and from a common diametrical line.

It should be understood that the radial projection of the lobes from the center of the bit can be varied in other ways, and by shifting the offset centers to a larger or lesser extent as may be desired to effect the oscillation or gyration of the center of the bit on the ledge of the casing. For examples of variations, the lobes may be formed in different numbers than shown and equal radii may be used from centers which are all offset from the true center.

Figure 10:
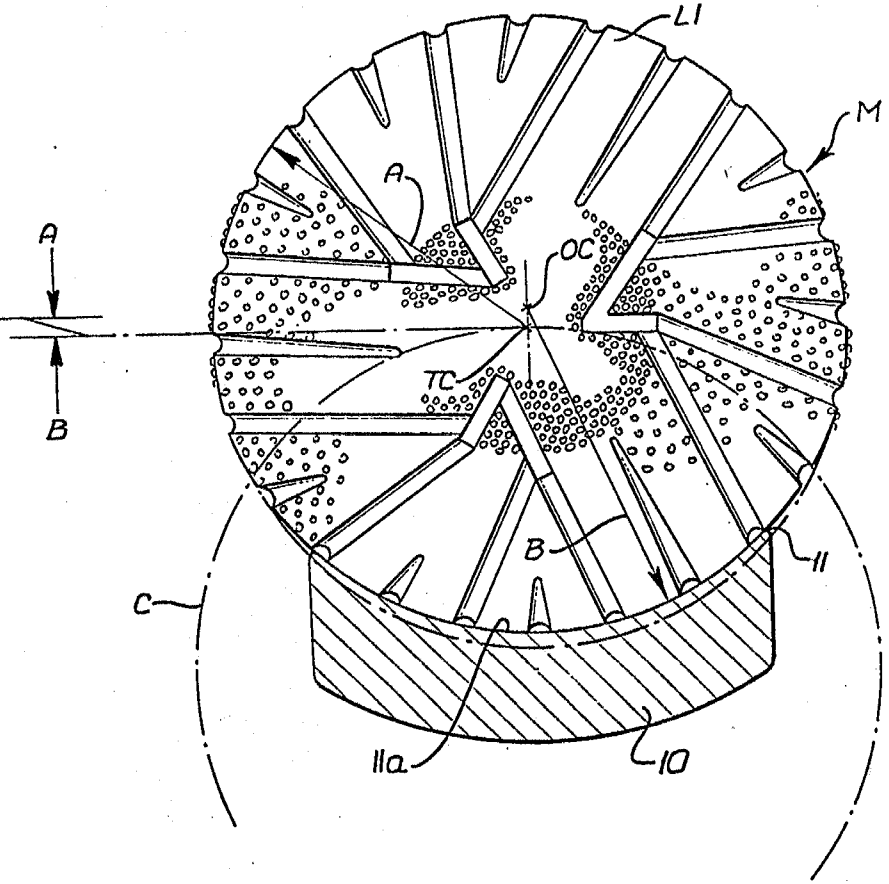
FIG. 10 is a view corresponding with FIG. 9 but showing the mill in the diametrically opposite angular position.
Figure 9:
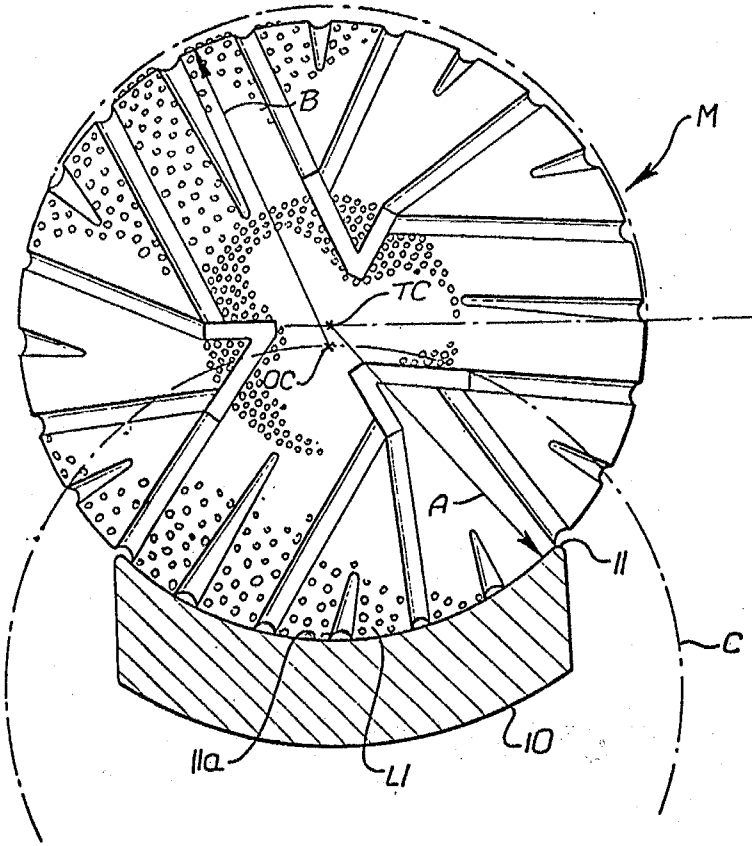
FIG. 9 is a view illustrating the cooperative relation between the mill of FIGS. 5 and 6 and the whipstock during the casing milling operation, with the mill in one angular position.
Figure 12:
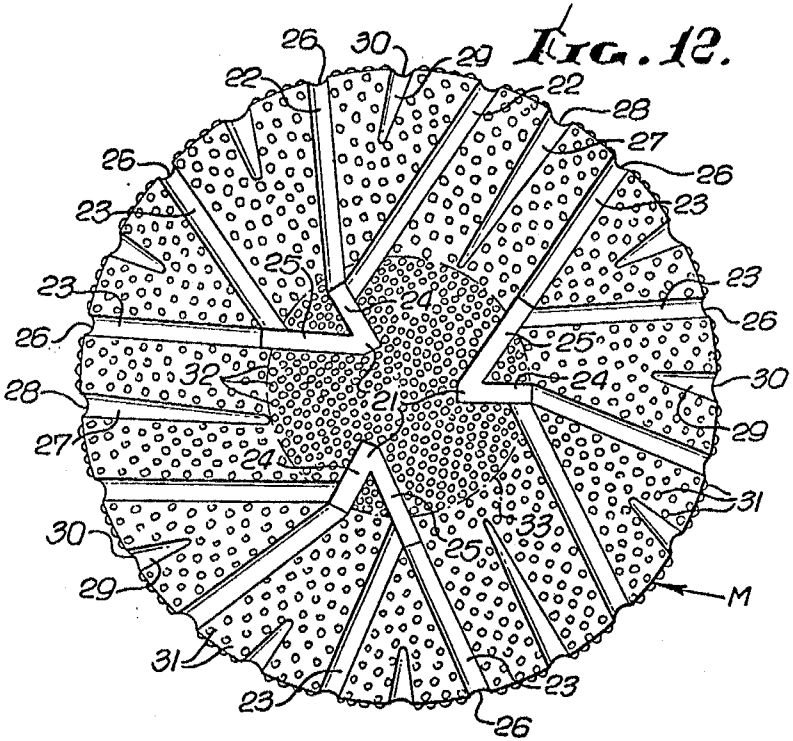
FIG. 12 is a bottom plan of the mill of FIG. 11.

Referring to FIGS. 9 and 10, the action of the bit against the trough or arcuate face 11*a* of the whipstock deflection surface 11 is illustrated with respect to a circular line indicative of the extent of lateral deflection of the bit per revolution, with respect to the center line of the casing C which is shown to partially embrace the whipstock shoe 10. The radius A is the full diameter, which is illustrated in FIG. 6 and forms the lobe L1, and the radius B extends from the offset center OC, so that each revolution of the bit will cause the bit to shift laterally with respect to the deflection shoe 10 and the center line of the casing C, the distance shown by the extent of the offset A-B between the centers TC and OC, as the lobe L1 moves between the position of FIG. 9, engaged with the shoe and the position illustrated in the comparative FIG. 10.

From the foregoing it is apparent that various bit forms may be provided by forming the periphery of the bit as portions of circumferentially extended and co-merging gage walls on the bit formed on various offset centers, whereby the bit gage has one or more peripheral eccentricities circumferentially spaced about the bit either in diametrically spaced relation or in circumferentially spaced but non-diametrical relationship. In any event, the eccentricity or eccentricities will cause the bit to be kicked off center by the whipstock shoe 10, so that the cutting action in the region of the center of the bit is enhanced and the rate of drilling by the cutter is improved during the period that the center of the bit is being oscillated or gyrated with respect to the center line of the casing.

Figure 11:
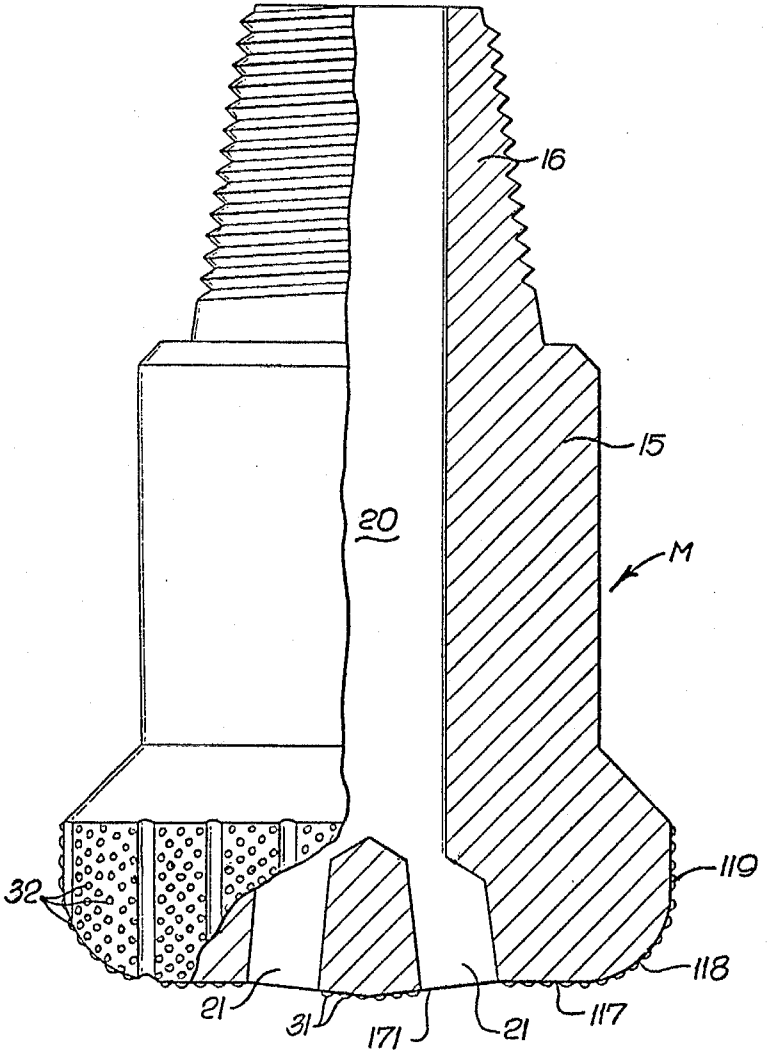
FIG. 11 is a view partly in elevation and partly in longitudinal section illustrating a further form of casing mill in accordance with the invention.

As seen in FIG. 11, the milling cutter or bit M is constructed in such a manner that it provides a surface cooperative with the casing itself, whereby to urge the bit off of a dead center position with respect to the casing. The milling cutter M has a body 15 provided with the upwardly projecting pin or neck threaded for engagement in the companion box at the lower end of the drill pipe or drill collar string D and has a substantially flat annular cutting section 117, which arches upwardly and outwardly at 118 to the outer periphery or bit gage 119. A passage 20 extends through the bit body for the flow of drilling fluid downwardly from the drill string through the bit body, the drilling fluid exiting through the crow-foot shaped discharge passages 21 to flush away cuttings and cool the bit face.

Extending outwardly from and communicating with the respective drilling fluid discharge openings 21 are the waterways or drilling fluid passages 22 and 23, the waterways 22 diverging outwardly towards the outer periphery or gage of the mill from an intersection with one branch 24 of the crow-foot shaped discharge passages 21, and the waterways 23 diverging outwardly from an intersection with the other branch 25 of the crow-foot shpaed discharge passages 21. Each of the waterways 22 and 23 merges with a vertically extended waterway or groove 26 in the reaming or gage portion 19 of the mill. Extending generally radially, and spaced between adjacent primary or high-pressure waterways 22 and 23 is a number of secondary or low pressure waterways 27 which merge with vertical waterways or grooves 28 in the gage of the milling cutter. Additional short radial secondary or low pressure waterways 29 are disposed between the primary waterways 22 and 23 and merge with vertical grooves 30 in the gage 119 of the mill. These various primary and secondary waterways in the face 117 define therebetween lands or surfaces containing cutting elements or diamonds 31 and 32 capable of milling the well casing material, as cooling and flushing drilling fluid is circulated downwardly through the drill string, through the mill central passage 20, exiting through the crow-foot shaped openings 21, then flowing through the primary waterways 22 and 23 and across the lands between the cutting elements to flush the cuttings therefrom and cool the bit as the milling progresses.

As illustrated, the cutting elements are diamonds or similar cutting elements secured in the cutting face 117 of the bit within a matrix (not shown separately), of a suitable type forming a portion of the bit body 15. It will be understood that the cutting elements may be other than the diamond cutting elements illustrated, as is well known in the art. As shown, the cutting elements 31 extend from the top of the gage portion 119 of the bit across the substantially flat undersurface 117 to a circle that extends about and approximately embraces the crow-foot passages 21. Within the circle 33 the cutting elements or diamonds are more densely arranged across the center of the bit between the region of the crow-foot shaped outlets and the axis of the bit.

In the present form, the bottom face of the bit has a central axial projection 171 illustrated as a broad conical surface having its apex at the center of the bit and flaring outwardly to a base circle approximately embracing the crow-foot shaped discharge passages 21, and having the more densely positioned cutting elements 32 thereon. During the drilling operation, as the apex of the cone cuts past the center line of the casing the receding slope of the cone will impose a lateral wedging force on the mill, by acting against the edge of the casing, thereby tending to kick the bit off center and enhancing the cutting action.

Figure 13:
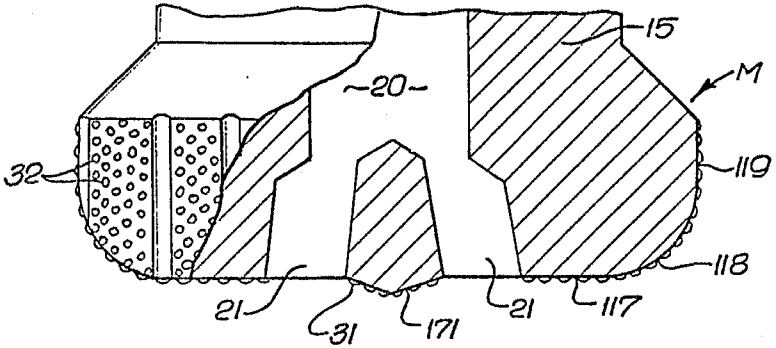
FIG. 13 is a fragmentary longitudinal section showing still another form of casing mill.

Referring to FIG. 13, a somewhat modified construction is illustrated wherein the broadly conical projection 171 again has its apex at the center of the bit but the wall of the conical projection extends circumferentially within the central region of the bit within the crow-foot like discharge passages 21.

It is apparent that the cone angle and projection can be modified to produce the desired lateral wedge action on the mill during its operation.

From the foregoing it will now be apparent that the present invention provides a milling cutter for elongating lateral windows in well casings off a whipstock deflection shoe, wherein the milling cutter is so constructed that it has means for forcing the cutter laterally off of a dead center position with respect to the upper edge of the casing window by acting against a fixed structure provided by the whipstock or by the casing. As a result, the casing mill is adapted to more effectively cut past the location at which normal casing mills tend to loose their cutting effectiveness as they revolve on a substantially dead center position on the casing edge.

I claim:

1. A rotary mill for elongating windows in a well casing off a casing whipstock comprising: a body connectible at one end to a rotary drill pipe string and having a substantially flat face at its other end, an axially extended gauge surface engageable with said whipstock to force said body laterally, cutting means on said body and extending from the periphery of said face across the center of said face for elongating a window in the casing responsive to rotation of the mill, said body having a portion thereon projecting outwardly from said body and providing surface means merging with said face for engaging a fixed structure to produce a force acting laterally on said body to move said face off center with respect to the edge of the casing.

2. A mill as defined in claim 1; said surface means being an eccentric side wall on said body.

3. A rotary mill for elongating windows in a well casing off a casing whipstock comprising: a body connectible at one end to a rotary drill pipe string and having a substantially flat face at its other end, an axially extended gauge surface engageable with said whipstock to force said body laterally, cutting means on said body and extending from the periphery of said face across the center of said face for elongating a window in the casing responsive to rotation of the mill, said body having a portion thereon projecting outwardly from said body and providing surface means for engaging fixed structure to produce a force acting laterally on said body to move said face off center with respect to the edge of the casing; said surface means being a wall on said body disposed on an incline and projecting from said flat face to the center of said body.

4. A mill as defined in claim 1; said cutting means being diamonds.

5. A rotary mill for elongating windows in a well casing off a casing whipstock comprising: a body connectible at one end to a rotary drill pipe string and having a substantially flat face at its other end, an axially extended gauge surface engageable with said whipstock to force said body laterally, cutting means on said body and extending from the periphery of said face across the center of said face for elongating a window in the casing responsive to rotation of the mill, said body having a portion thereon projecting outwardly from said body and providing surface means for engaging fixed structure to produce a force acting laterally on said body to move said face off center with respect to the edge of the casing; said cutting means being diamonds extending across the center of said face, said diamonds being arranged in an annular pattern spaced about the center of said face and in a circular pattern at the center of said face, the diamonds in said circular pattern being more dense than in said annular pattern.

6. A mill as defined in claim 1; said surface means being a side wall of said body having at least one eccentric region.

7. A mill as defined in claim 1; said surface means being circular side walls of said body alternately concentric and eccentric.

8. A mill as defined in claim 1; said surface means comprising circular side walls on the gauge of said body forming diametrically opposite eccentric and concentric wall sections.

9. A mill as defined in claim 1; said surface means being circular side walls on the gauge of said body alternately concentric and eccentric, said cutting means being diamonds.

10. A rotary mill for elongating windows in a well casing off a casing whipstock comprising: a body connectible at one end to a rotary drill pipe string and having a substantially flat face at its other end, an axially extended gauge surface engageable with said whipstock to force said body laterally, cutting means on said body and extending from the periphery of said face across the center of said face for elongating a window in the casing responsive to rotation of the mill, said body having a portion thereon projecting outwardly from said body and providing surface means for engaging fixed structure to produce a force acting laterally on said body to move said face off center with respect to the edge of the casing; said surface means being circular side walls on the gauge of said body alternately concentric and eccentric, said cutting means being diamonds extending across the center of said face, said diamonds being arranged in an annular pattern about the center of said face and in a circular pattern at the center of said face, the diamonds in said circular pattern being more dense than in said annular pattern.

11. A mill as defined in claim 10; said drilling fluid passage opening through said face at circumferentially spaced locations about the center of said body.

12. A mill as defined in claim 10; said face having waterways extending laterally to said side walls.

13. A rotary mill for elongating windows in a well casing off a casing whipstock comprising: a body having upper connector means at one end for securing said body to a rotary drill pipe string and having a substantially flat face at its other end, an axially extended gauge surface engageable with said whipstock to force said body laterally, cutting means on said body and extending from the periphery of said face across the center of said face for elongating a window in the casing responsive to rotation of the mill, said body having a portion thereon projecting outwardly from said body and providing surface means merging with said face for engaging fixed structure to produce a force acting laterally on said body to move said face off center with respect to the edge of the casing; said surface means comprising a broadly conical center projecting from said body.

14. A mill as defined in claim 13; said drilling fluid passage opening through said face at circumferentially spaced locations about the center of said body.

15. A mill as defined in claim 13; said drilling fluid passage opening through said face at cercumfentially spaced locations about the center of said body through said conical projection.

16. A mill as defined in claim 13; said cutting means being diamonds.

17. A mill as defined in claim 14; said cutting means being diamonds, said diamonds being arranged in an annular pattern outside of said conical projection and in a more dense circular pattern on said conical projection.

18. A mill as defined in claim 14; said cutting means being diamonds, said drilling fluid passage opening through said face at circumferentially spaced locations about the center of said body.

19. A mill as defined in claim 14; said cutting means being diamonds, and said face having waterways extending laterally to said side walls.

20. A rotary mill for elongating windows in well casing off a casing whipstock comprising: a body connectible at one end to a drill pipe string having a substantially flat face at its other end, an axially extended gauge surface engageable with said whipstock to force said body laterally, cutting means on said body, and extending from the periphery said face, for elongating a window in the casing responsive to rotation of the mill, said body having a drilling fluid passage extending lonitudinally therein and opening through said face, and said body having a portion therein projecting outwardly from said body and providing surface means for engaging fixed struture to produce a force acting literally on said body to move said face off center with respect to the edge of the casing; said surface means being circular side walls of said body alternately concentric and eccentric.

21. A rotary mill for elongating windows in a well casing off a casing whipstock comprising: a body connectible at one end to a rotary drill pipe string and having a substantially flat face at its other end, cutting means on said face, for elongating a window in the casing responsive to rotation of the mill, said body having a drilling fluid passage extending longitudinally therein and opening through said face in radially spaced relation to the center of said face, and said body having surface means for engaging fixed structure to produce a force acting laterally on said body to move said face off center with respect to the edge of the casing: said surface means comprising circular side walls of of said body forming a eccentric section extending about one half of said body and a concentric section extending about the opposite half of said body.

22. A rotary mill for elongating windows in a well casing off a casing whipstock comprising: a body connectible at one end to a rotary drill pipe string and having a substantially flat face at its other end, cutting means on said face for elongating a window in the casing responsive to rotation of the mill, said body having a drilling fluid passage extending longitudinally therein and opening through said face in radially spaced relation to the center of said face, and said body having surface means for engaging fixed structure to produce a force acting laterally on said body to move said face off center with respect to the edge of the casing; said surface means comprising circular side walls of said body forming diametrically opposite eccentric wall sections and intervening diametrically opposite concentric sections.

23. A rotary mill for elongating windows in a well casing off a casing whipstock comprising; a body connectible at one end to a rotary drill pipe string and having a substantially flat face at its other end, cutting means on said face for elongating a window in the casing responsive to rotation of the mill, said body having a drilling fluid passage extending longitudinally therein and opening through said face in radially spaced relation to the center of said face, and said body having surface means for engaging fixed structure to produce a force acting laterally on said body to move said face off center with respect to the edge of the casing; said surface means comprising circular side walls of said body forming a plurality of alternately eccentric sections and intervening concentric sections.

24. A rotary mill for elongating windows in a well casing off a casing whipstock comprising: a body connectible at one end to a rotary drill pipe string and having a substantially flat face at its other end, cutting means on said face for elongating a window in the casing responsive to rotation of the mill, said body having a drilling fluid passage extending longitudinally therein and opening through said face in radially spaced relation to the center of said face, and said body having surface means for engaging fixed structure to produce a force acting laterally on said body to move said face off center with respect to the edge of the casing; said surface means comprising a broadly conical center projecting from said body, said drilling fluid passage opening through said face at circumferentially spaced locations about the center of said body outside the base of said conical projection.

25. A rotary mill for elongating windows in a well casing off a whipstock comprising: a generally circular body connectible at one end to a rotary drill pipe string and having a flat face at its other end; a peripheral gauge extending from said flat face toawards said one end for engagement with the whipstock; cutting elements distributed across said flat face from said peripheral gauge across the center of said flat face for elongating a window in the casing responsive to rotation of the mill; said body having at least one drilling fluid passage extending longitudinally therein and opening through said flat face in radially spaced relation to the center of said body; said gauge being eccentric to cause said mill to rotate on a gyratory axis due to engagement of said gauge with the whipstock during rotation of said mill.

26. A mill as defined in claim 25; said gauge being formed by circular wall of said body alternately concentric and eccentric and having radii of equal length.

27. A mill as defined in claim 25; said guage being formed by circular walls forming an eccentric section extending about one half of said body and a concentric section extending about the opposite half of said body.

28. A mill as defined in claim 25; said gauge being formed by circular walls of said body providing diametrically opposite eccentric and concentric wall sections.

29. A mill as defined in claim 25; said surface means being circular side walls of said body alternately concentric and eccentric, said cutting means being diamonds extending across the center of said face, said diamonds being arranged in an annular pattern about the center of said face and in a circular pattern at the center of said face, the diamonds in said circular pattern being more dense than in said annular pattern.

30. A mill as defined in claim 25; said surface means being circular side walls of said body alternately concentric and eccentric, said cutting means being diamonds extending across the center of said face, said diamonds being arranged in an annular pattern about the center of said face and in a circular pattern at the center of said face the diamonds in said circular pattern being more dense than in said annular pattern, said drilling fluid passage opening through said face at circumferentially spaced locations about the center of said body.

31. A mill as defined in claim 25; said surface means being circular side walls of said body alternately concentric and eccentric, said cutting means being diamonds extending across the center of said face, said diamonds being arranged in an annular pattern about the center of said face and in a circular pattern at the center of said face, the diamonds in said circular pattern being more dense than in said annular pattern, said drilling fluid passage opening through said face at circumferentially spaced locations about the center of said body, and said face having waterways extending laterally to said side walls.

32. A rotary mill for elongating windows in a well casing off a shipstock comprising: a circular body having upper connector means at one end for securing said body to a rotary drill pipe string and having an annular flat face at its other end; a peripheral generally cylindrical gauge extending from said flat face towards said connector means for engagement with the whipstock; cutting elements distributed across said flat face from said peripheral gauge for elongating a window in the casing responsive to rotation of the mill; said body having at least one drilling fluid passage extending longitudinally therein and opening through said other end in radially spaced relation to the center of said body; and a circular forward projection having a cam surface extending from the center of said body outwardly to said annular flat face for forcing said mill laterally off of said casing; said projection having cutting elements extending from the center and in all directions to said flat face.

33. A mill as defined in claim 32; said projection being broadly conical.

34. A mill as defined in claim 32; said projection being broadly conical; said drilling fluid passage opening through said face at circumferentially spaced locations about the center of said body.

35. A mill as defined in claim 32; said projection being broadly conical; said drilling fluid passage opening through said face at circumferentially spaced locations about the center of said body through said conical projection.

36. A mill as defined in claim 32; said projection being broadly conical; said drilling fluid passage opening through said face at circumferentially spaced locations about the center of said body through said annular flat face outside the base of said conical projection.

37. A mill as defined in claim 32; said cutting means being diamonds.

38. A mill as defined in claim 34; said diamonds being arranged in an annular pattern on said annular face and in a more dense circular pattern on said projection.

39. A mill as defined in claim 32; said cutting means being diamonds; said drilling fluid passage opening through said other end at circumferentially spaced locations about the center of said body.

40. A mill as defined in claim 32; said cutting means being diamonds; said annular flat face having waterways extending laterally from said passage to said gauge.

* * * * *